US006773242B1

(12) United States Patent
Perevozchikov

(10) Patent No.: US 6,773,242 B1
(45) Date of Patent: Aug. 10, 2004

(54) SCROLL COMPRESSOR WITH VAPOR INJECTION

(75) Inventor: Michael Michael Perevozchikov, Troy, OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 10/663,130

(22) Filed: Sep. 16, 2003

Related U.S. Application Data

(62) Division of application No. 10/050,727, filed on Jan. 16, 2002, now Pat. No. 6,619,936.

(51) Int. Cl.[7] ..... F04C 18/02

(52) U.S. Cl. ..... 418/55.2; 418/55.1; 418/55.5; 418/57; 418/55.6

(58) Field of Search ..... 418/55.2, 55.1, 418/55.5, 57, 55.6, 97

(56) References Cited

U.S. PATENT DOCUMENTS

| | | | |
|---|---|---|---|
| 3,994,633 | A | 11/1976 | Shaffer |
| 4,082,484 | A | 4/1978 | McCullough |
| 4,160,629 | A | 7/1979 | Hidden et al. |
| 4,192,152 | A | 3/1980 | Armstrong et al. |
| 4,417,863 | A | 11/1983 | Ikegawa et al. |
| 4,475,360 | A | 10/1984 | Suefuji et al. |
| 4,494,914 | A | 1/1985 | Shiibayashi |
| 4,545,747 | A | 10/1985 | Tamura et al. |
| 4,549,861 | A | 10/1985 | Blain |
| 4,553,913 | A | 11/1985 | Morishita et al. |
| 4,560,330 | A | 12/1985 | Murayama et al. |
| 4,568,256 | A | 2/1986 | Blain |
| 4,575,318 | A | 3/1986 | Blain |
| 4,596,520 | A | 6/1986 | Arata et al. |
| 4,600,369 | A | 7/1986 | Blain |
| 4,610,610 | A | 9/1986 | Blain |
| 4,611,975 | A | 9/1986 | Blain |
| 4,613,291 | A | 9/1986 | Sidransky |
| 4,676,075 | A | 6/1987 | Shiibayashi |
| 4,690,625 | A | 9/1987 | Murayama et al. |
| 4,744,737 | A | 5/1988 | Yamamura et al. |
| 4,767,293 | A | 8/1988 | Caillat et al. |
| 4,802,831 | A | 2/1989 | Suefuji et al. |
| 4,818,195 | A | 4/1989 | Murayama et al. |
| 4,889,471 | A | 12/1989 | Izunaga et al. |
| 4,929,160 | A | 5/1990 | Inoue |
| 4,936,756 | A | 6/1990 | Shimizu et al. |
| 4,950,135 | A | 8/1990 | Tojo et al. |
| 4,992,033 | A | 2/1991 | Caillat et al. |
| 5,037,279 | A | 8/1991 | Suefuji et al. |
| 5,040,958 | A | 8/1991 | Arata et al. |
| 5,076,067 | A | 12/1991 | Prenger et al. |
| 5,090,880 | A | 2/1992 | Mashimo |
| 5,103,652 | A | 4/1992 | Mizuno et al. |
| 5,174,740 | A | 12/1992 | Jang |
| 5,329,788 | A | 7/1994 | Caillat et al. |
| 5,469,716 | A | 11/1995 | Bass et al. |
| 5,640,854 | A | 6/1997 | Fogt et al. |
| 6,089,839 | A | 7/2000 | Bush et al. |

FOREIGN PATENT DOCUMENTS

| | | | | | |
|---|---|---|---|---|---|
| EP | 1182353 | A1 | * | 2/2002 | ..... F04C/23/00 |
| JP | 02245490 | A | * | 10/1990 | ..... F04C/18/02 |
| JP | 04022781 | A | * | 1/1992 | ..... F04C/18/02 |
| JP | 04031683 | A | * | 2/1992 | ..... F04C/18/02 |
| JP | 2001050181 | A | * | 2/2001 | ..... F04C/18/02 |
| JP | 2003120555 | A | * | 4/2003 | ..... F04C/18/02 |

* cited by examiner

*Primary Examiner*—Thomas Denion
*Assistant Examiner*—Theresa Trieu
(74) *Attorney, Agent, or Firm*—Harness, Dickey & Pierce, P.L.C.

(57) ABSTRACT

A scroll compresssor incorporates a vapor injection system where only one vapor injection port is utilized. The single vapor injection port injects refrigerant vapor into two of the initially formed enclosed spaces. The scrolls of the scroll compressor are designed with asymmetric wraps where the non-orbiting scroll wrap extends angularly further than the orbiting scroll wrap.

13 Claims, 5 Drawing Sheets

SCROLL COMPRESSOR WITH VAPOR INJECTION

This is a division of U.S. patent application Ser. No. 10/050,727, filed on Jan. 16, 2002, now U.S. Pat. No. 6,619,936 issued Sep. 16, 2003. The disclosures of the above applications are incorporated herein by reference.

FIELD OF THE INVENTION

The present invention relates to scroll type machines. More particularly, the present invention relates to scroll compressors incorporating a vapor injection system which utilizes a single large port extending through a scroll member.

BACKGROUND AND SUMMARY OF THE INVENTION

Refrigeration and air conditioning systems generally include a compressor, a condenser, an expansion valve or equivalent, and an evaporator. These components are coupled in sequence in a continuous flow path. A working fluid flows through the system and alternates between a liquid phase and a vapor or gaseous phase.

A variety of compressor types have been used in refrigeration systems, including but not limited to reciprocating compressors, screw compressors and rotary compressors. Rotary compressors can both include the vane type compressors as well as the scroll machines. Scroll machines are constructed using two scroll members with each scroll member having an end plate and a spiral wrap. The spiral wraps are arranged in an opposing manner with the two spiral wraps being interfitted. The scroll members are mounted so that they may engage in relative orbiting motion with respect to each other. During this orbiting movement, the spiral wraps define a successive series of enclosed spaces, each of which progressively decreases in size as it moves inwardly from a radially outer position at a relatively low suction pressure to a central position at a relatively high pressure. The compressed gas exits from the enclosed space at the central position through a discharge passage formed through the end plate of one of the scroll members.

Refrigeration systems are now incorporating vapor injection systems where a portion of the refrigerant in gaseous form is injected into the enclosed spaces at a pressure which is intermediate the low suction pressured and the relatively high pressure or what is termed discharge pressure. This gaseous refrigerant is injected into the enclosed spaces through injection ports extending through one of the two scroll members. The injection of this gaseous refrigerant has the effect of increasing both system capacity and the efficiency of the compressor. In systems where vapor injection is incorporated to achieve maximum capacity increase, the development engineer attempts to provide a system which will maximize the amount of refrigerant gas that is injected into the enclosed pocket. By maximizing the amount of refrigerant gas that is injected, the system capacity and the efficiency of the compressor are maximized.

When developing the vapor injection system, the development engineer must ensure that the intermediate pressurized vapor that is being injected is not allowed to migrate into the suction chamber of the compressor. If the intermediate pressurized vapor does migrate into the suction area, the capacity of the compressor will actually decrease. Thus, vapor injection ports are typically placed at a location where they do not communicate with an enclosed space until the enclosed space has been sealed.

There have been attempts to locate the vapor injection ports at a position where they open just prior to the sealing of the enclosed space. The theory is that the enclosed space will be sealed prior to any of the intermediate pressurized vapor migrating to the suction chamber. While these systems have increased the amount of refrigerant vapor that is injected, the increase in the amount of refrigerant vapor that is injected is less than an optimal amount.

Thus, the continued development of vapor injection systems is directed towards increasing the amount of intermediate pressurized vapor that can be injected into the enclosed spaces.

The present invention provides the art with an injection system which utilizes a single large injection port and which injects intermediate pressurized vapor refrigerant into two different enclosed pockets of a scroll compressor having asymmetric scroll wraps. The single large injection port allows for an increased amount of the vapor to be injected into both of the enclosed spaces without the possibility of the injected vapor migrating to the suction area of the compressor.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 6 is a plan view of the scroll members positioned at the point where the vapor injection port is open to two enclosed spaces.

DETAILED DESCRIPTION OF THE PREFERRED EMBODIMENTS

The following description of the preferred embodiment(s) is merely exemplary in nature and is in no way intended to limit the invention, its application, or uses.

Figure 1:
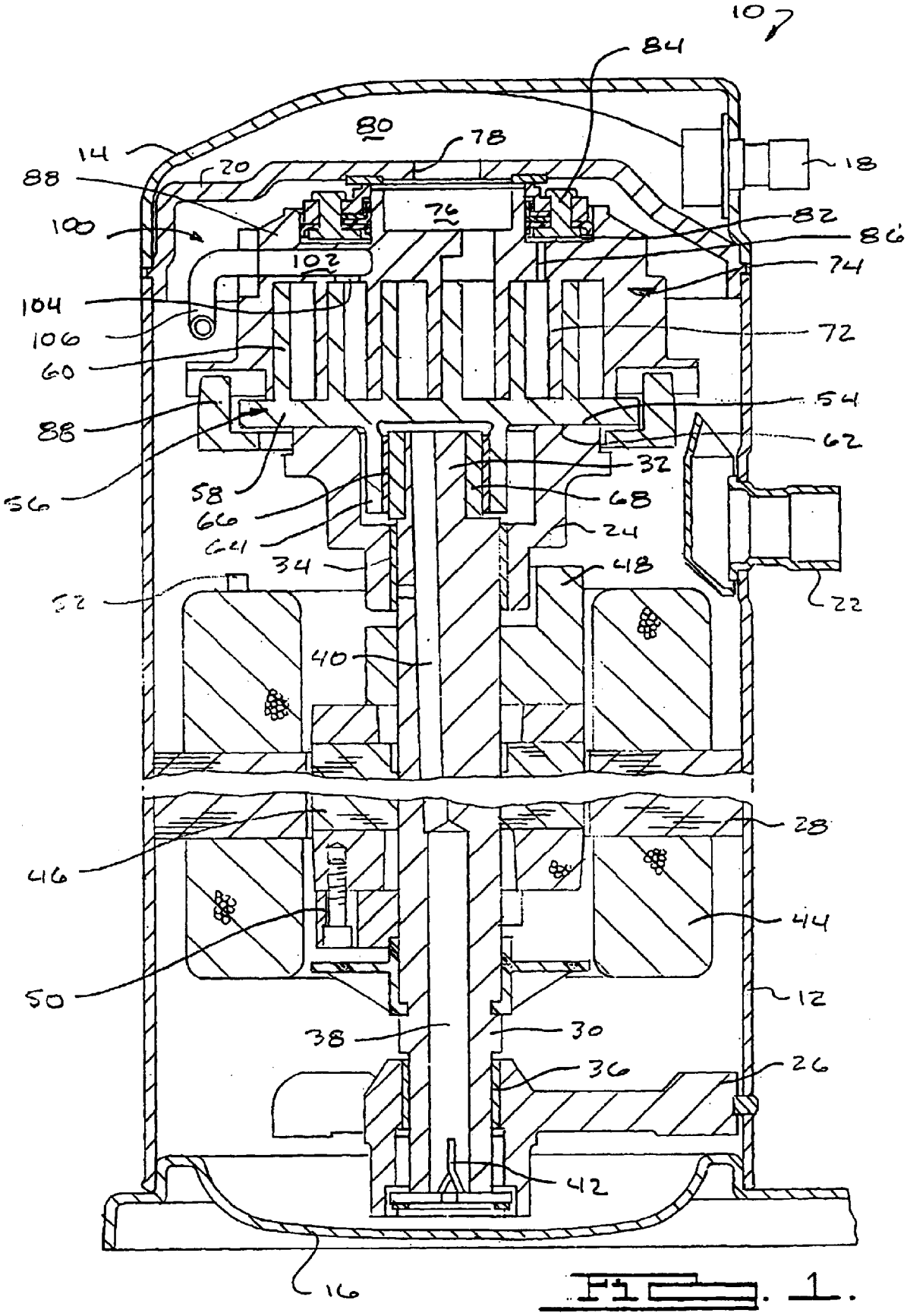
FIG. 1 is a vertical cross-section of a scroll compressor incorporating the unique vapor injection system in accordance with the present invention.

Referring now to the drawings in which like reference numerals designate like or corresponding parts throughout the several views, there is shown in FIG. 1, a scroll compressor which incorporates the unique vapor injection system in accordance with the present invention and which is designated generally by the reference numeral 10. The following description of the preferred embodiment is merely exemplary in nature and is no way intended to limit the invention, its application or its uses.

Scroll compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to shell 12 include a transversely extending partition 20 which is welded about its periphery at the same point cap 14 is welded to shell 12, an inlet fitting 22, a main bearing housing 24 which is suitably secured to shell 12 and a lower bearing housing 26 having a plurality of radially outwardly extending legs each of which is suitably secured to shell 12. A motor stator 28 which is generally square in cross-section but with the corners rounded off is press fit into shell 12. The flats between the rounded corners on motor stator 28 provide passageways between motor stator 28 and shell 12 which facilitate the return flow of the lubricant from the top of shell 12 to its bottom.

A drive shaft or crankshaft 30 having an eccentric crank pin 32 at the upper end thereof is rotatably journaled in a bearing 34 in main bearing housing 24 and in a bearing 36 in lower bearing housing 26. Crankshaft 30 has at the lower end thereof a relatively large diameter concentric bore 38 which communicates with a radially outwardly located smaller diameter bore 40 extending upwardly therefrom to the top of crankshaft 30. Disposed within bore 38 is a stirrer 42. The lower portion of the interior shell 12 is filled with lubricating oil and bores 38 and 40 act as a pump to pump the lubricating oil up crankshaft 30 and ultimately to all of the various portions of compressor 10 which require lubrication.

Crankshaft 30 is relatively driven by an electric motor which includes motor stator 28 having motor windings 44 passing therethrough and a motor rotor 46 press fitted onto crankshaft 30 and having upper and lower counterweights 48 and 50, respectively. A motor protector 52, of the usual type, is provided in close proximity to motor windings 44 so that if the motor exceeds its normal temperature range, motor protector 52 will de-energize the motor.

The upper surface of main bearing housing 24 is provided with an annular flat thrust bearing surfaces 54 on which is disposed an orbiting scroll member 56. Scroll member 56 comprises an end plate 58 having the usual spiral valve or wrap 60 on the upper surface thereof and an annular flat thrust surface 62 on the lower surface thereof. Projecting downwardly from the lower surface is a cylindrical hub 64 having a journal bearing 66 therein and in which is rotatively disposed a drive bushing 68 having an inner bore within which crank pin 32 is drivingly disposed. Crank pin 32 has a flat on one surface (not shown) which drivingly engages a flat surface in a portion of the inner bore of drive bushing 68 to provide a radially compliant drive arrangement such as shown in assignee's U.S. Pat. No. 4,877,382, the disclosure of which is incorporated herein by reference.

Wrap 60 meshes with a non-orbiting scroll wrap 72 forming part of a non-orbiting scroll member 74. During orbital movement of orbiting scroll member 56 with respect to non-orbiting scroll member 74 creates moving pockets of fluid which are compressed as the pocket moves from a radially outer position to a central position of scroll members 56 and 74. Non-orbiting scroll member 74 is mounted to main bearing housing 24 in any desired manner which will provide limited axial movement of non-orbiting scroll member 74. The specific manner of such mounting is not critical to the present invention.

Non-orbiting scroll member 74 has a centrally disposed discharge port 76 which is in fluid communication via an opening 78 in partition 20 with a discharge muffler 80 defined by cap 14 and partition 20. Fluid compressed by the moving pockets between scroll wraps 60 and 72 discharges into discharge muffler 80 through port 76 and opening 78. Non-orbiting scroll member 74 has in the upper surface thereof an annular recess 82 having parallel coaxial sidewalls within which is sealing disposed for relative axial movement an annular seal assembly 84 which serves to isolate the bottom of recess 82 so that it can be placed in fluid communication with a source of intermediate fluid pressure by means of a passageway 86. Non-orbiting scroll member 74 is thus axially biased against orbiting scroll member 56 by the forces created by discharge pressure acting on the central portion of non-orbiting scroll Member 74 and the forces created by intermediate fluid pressure acting on the bottom of recess 82. This axial pressure biasing, as well as the various techniques for supporting non-orbiting scroll member 74 for limited axial movement, are disclosed in much greater detail in assignee's aforementioned U.S. Pat. No. 4,877,382.

Relative rotation of scroll members 56 and 74 is prevented by the usual Oldham Coupling 88 having a pair of key slidably disposed in diametrically opposing slots in non-orbiting scroll member 74 and a second pair of keys slidably disposed in diametrically opposed slots in orbiting scroll member 56.

Compressor 10 is preferably of the "low side" type in which suction gas entering shell 12 is allowed, in part, to assist in cooling the motor. So long as there is an adequate flow of returning suction gas, the motor will remain within the desired temperature limits. When this flow ceases, however, the loss of cooling will cause motor protector 52 to trip and shut compressor 10 down.

The scroll compressor, as thus broadly described, is either known in the art or it is the subject matter of other pending applications for patent by Applicant's assignee. The details of construction which incorporate the principles of the present invention are those which deal with a unique vapor injection system identified generally by reference numeral 100. Vapor injection system 100 is used to inject vapor or gaseous refrigerant for increasing the capacity and efficiency of compressor 10.

Figure 2:
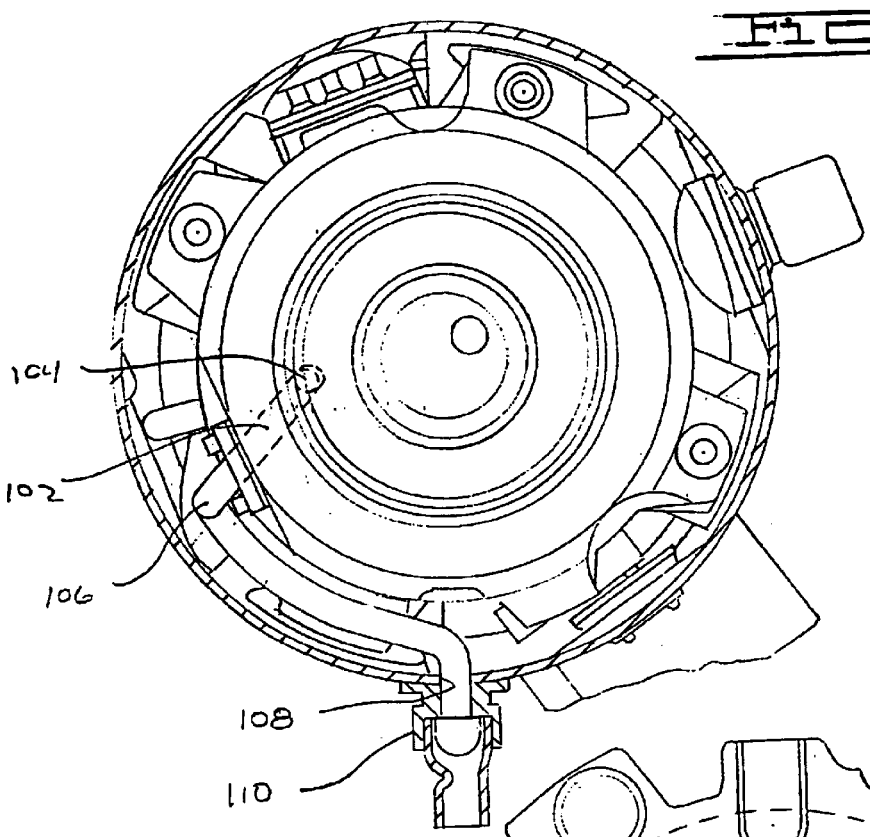
FIG. 2 is a horizontal sectional view of the scroll compressor of the present invention taken just below the partition in FIG. 1.
Figure 3:
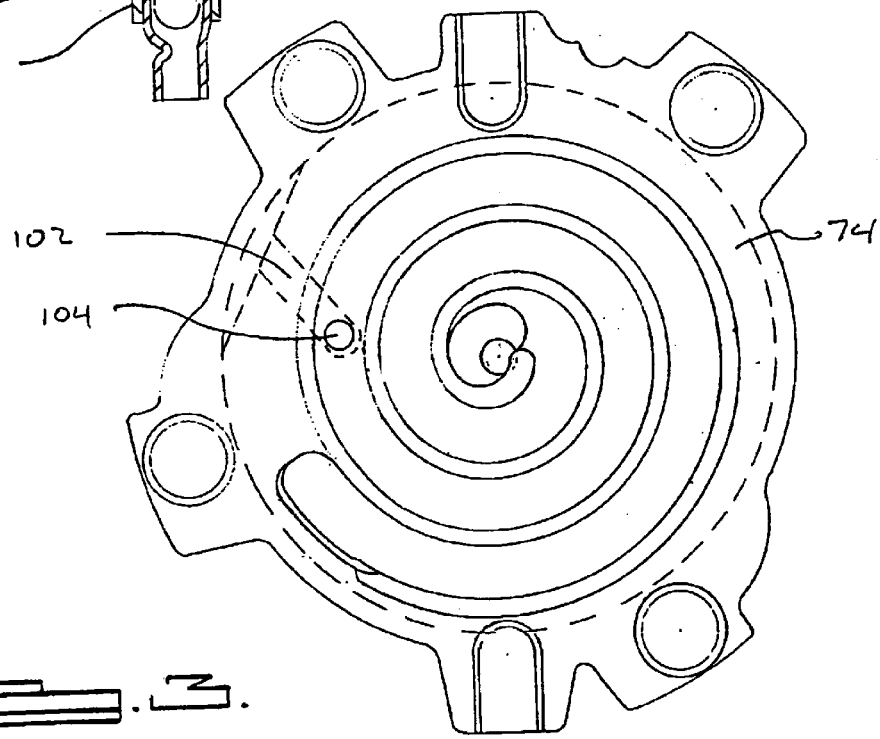
FIG. 3 is a plan view of the non-orbiting scroll of the present invention viewed from the vane side of the non-orbiting scroll.

Referring now to FIGS. 1–3, vapor injection system 100 comprises a vapor injection passage 102 extending through an end plate 88 of non-orbiting scroll member 74, a single vapor injection port 104 opening into the enclosed fluid pockets, a connecting tube 106, a fluid injection port 108 extending through shell 12 and a vapor injection fitting 110 secured to the outside of shell 12.

Vapor injection passage 102 is a cross drill feed hole which extends generally horizontal through non-orbiting scroll member 74 from a position on the exterior of non-orbiting scroll member 74 to a position where it communicates with vapor injection port 104. Vapor injection port 104 extends generally vertically from passage 102 through non-orbiting scroll member 74 to open into the enclosed spaces or pockets formed by wraps 60 and 72 as detailed below. Connecting tube 106 extends from vapor injection passage 102 to fluid injection port 108 where it extends through fluid injection port 108 to be sealingly secured to vapor injection fitting 110. While not shown, the source of the intermediate pressurized refrigerant vapor from a refrigeration system (not shown) is in communication with vapor injection fitting 110 to provide the refrigerant vapor for injecting.

Figure 4:
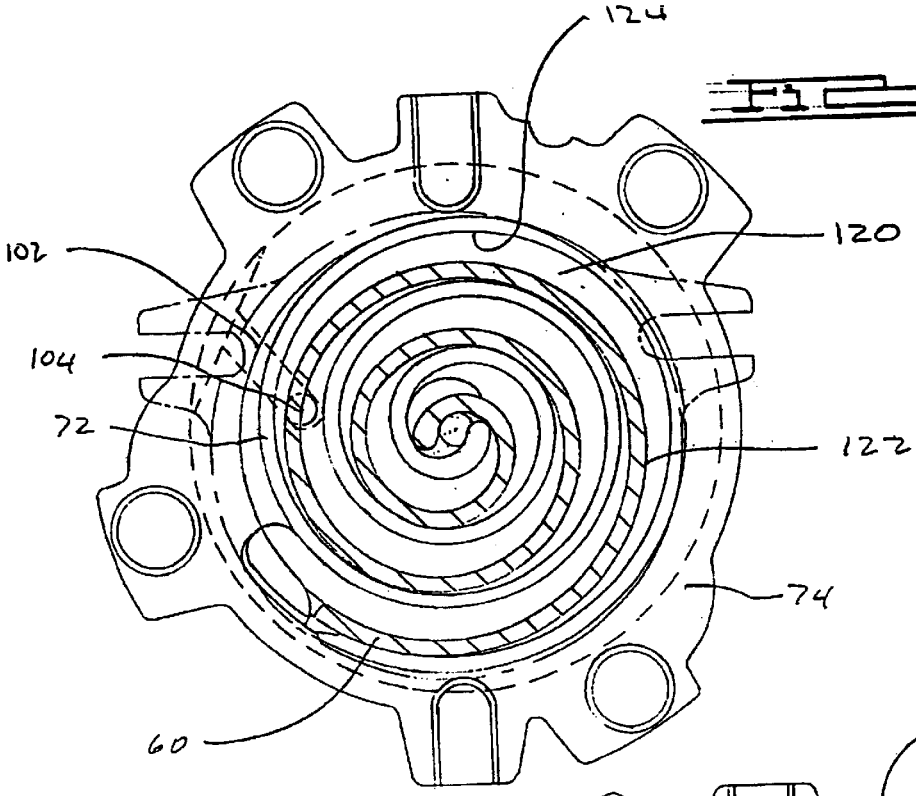
FIG. 4 is a plan view of the scroll members positioned at the point of initially sealing off the first enclosed space.
Figure 5:
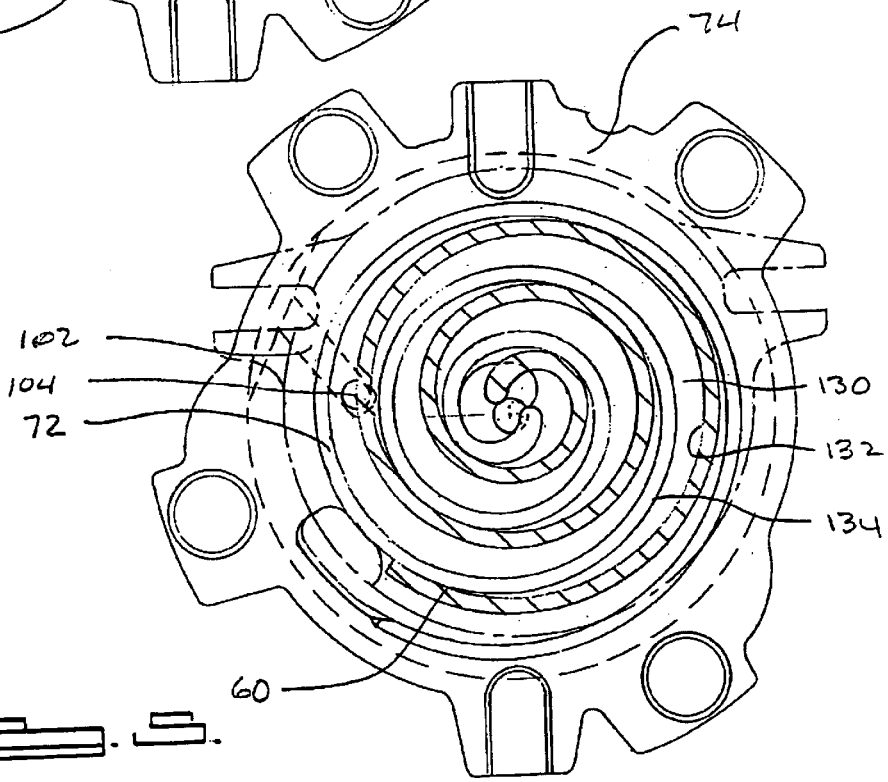
FIG. 5 is a plan view of the scroll members positioned at the point of initially sealing off the second enclosed space.
Figure 5:
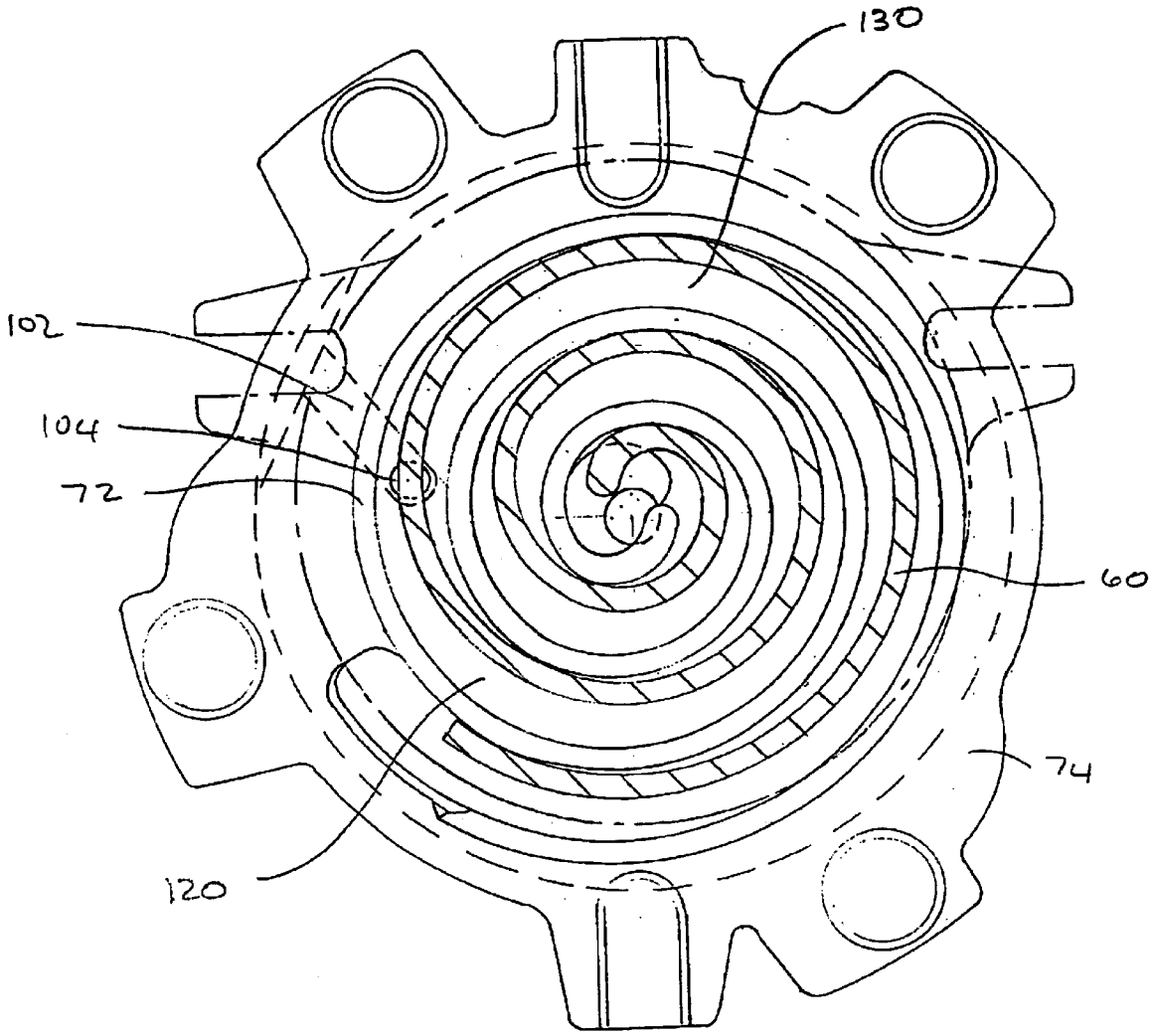

Referring now to FIGS. 4 and 5, the positioning of vapor injection port 104 is illustrated in relation to scroll wraps 60 and 72. As can be seen in FIGS. 4 and 5, scroll wraps 60 and 72 are asymmetrically designed. Non-orbiting scroll wrap 72 extends an additional angular amount to provide the asymmetrical profile. In the preferred embodiment, non-orbiting scroll wrap 72 extends 1 7Q0 further than orbiting scroll wrap 60. The asymmetrical profile of scroll wraps 60 and 72 causes the two fluid pockets created by wraps 60 and 72 to be initially sealed off at different positions of the orbiting motion of orbiting scroll member 56. FIG. 4 illustrates the initial sealing point of an enclosed space 120 which is sealed when an outer surface 122 of orbiting scroll wrap 60 engages an inner surface 124 of non-orbiting scroll wrap 72. Just prior to the time of sealing enclosed space 120, vapor injection port 104 is sealed off or closed by orbiting scroll wrap 60 as shown in FIG. 4. This ensures that there will not be any intermediate pressurized refrigerant vapor that is allowed to migrate to the suction chamber of compressor 10. Simultaneous with the sealing of enclosed space 120 by surfaces 122 and 124, orbiting scroll wrap 60 begins to uncover or open vapor injection port 104 to begin the injection of refrigerant vapor into enclosed space 120. While FIG. 4 is illustrated with vapor injection port 104 opening simultaneous with the sealing of enclosed space 120, it is within the scope of the present invention to open vapor injection port 104 prior to or subsequent to the sealing of enclosed space 120 if desired.

FIG. 5 illustrates the initial sealing point of an enclosed space 130 which is sealed when an inner surface 132 of orbiting scroll wrap 60 engages an outer surface 134 of non-orbiting scroll wrap 72. Just prior to the time of sealing enclosed space 130, vapor injection port 104 is sealed off or closed by orbiting scroll wrap 60 as shown in FIG. 5. This ensures that there will not be any intermediate pressurized refrigerant vapor that is allowed to migrate to the suction chamber of compressor 10. Simultaneous with the sealing of enclosed space 130 by surfaces 132 and 134, orbiting scroll wrap 60 begins to uncover or open vapor injection port 104 to begin the injection of refrigerant vapor into enclosed's pace 130. While FIG. 5 is illustrated with vapor injection port 104 opening simultaneous with the sealing of enclosed space 130, it is within the scope of the present invention to open vapor injection port 104 prior to or subsequent to the sealing of enclosed space 130 if desired.

As can be seen in FIG. 6, the size of vapor injection port 104 is significantly larger than the width of orbiting scroll wrap 60. This means that during a portion of the cycle for orbiting scroll 56, vapor injection port 104 will be open to both enclosed space 120 and enclosed space 130. This does not present a problem to the operation and function of vapor injection system 100 because the pressure of refrigerant vapor at vapor injection port 104 is always larger than the pressure of refrigerant gas in enclosed spaces 120 and 130. The increased size for vapor injection port 104 allows for the unique ability of a single port being able to open to both enclosed spaces 120 and 130 simultaneous to the sealing of the respective enclosed space. In addition, the increased size of vapor injection port 104 allows for the injection of an increased amount of intermediate pressurized gas to increase the capacity and efficiency of compressor 10.

Figure 7:
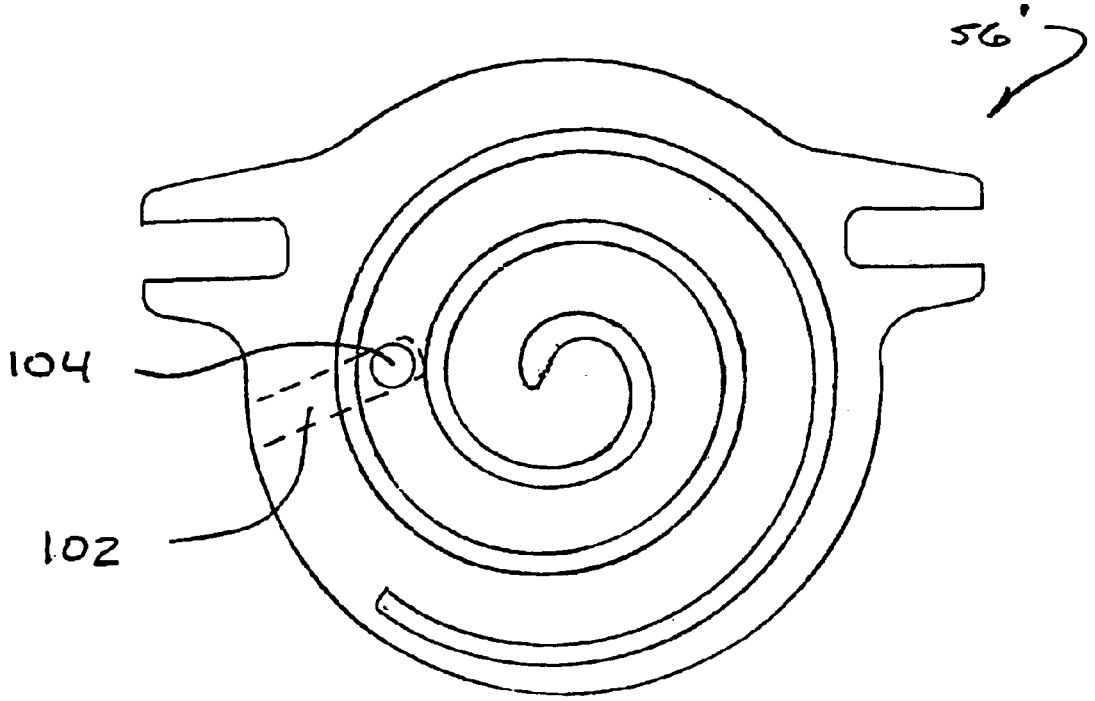
FIG. 7 is a plan view of an orbiting scroll in accordance with another embodiment of the present invention viewed from the vane side of the orbiting scroll.

Referring now to FIG. 7, an orbiting scroll member 56' is illustrated. Orbiting scroll member 56' is the same as orbiting scroll 56 except that vapor injection passage 102 and vapor injection port 104 are located in orbiting scroll 56' instead of non-orbiting scroll member 74. Vapor injection passage 102 which extends through orbiting scroll member 56' is in communication with the exterior of shell 12 by utilizing connecting tube 106 or by other means known well in the art. Other methods of providing communication for vapor injection passage 102 and vapor injection port 104 are shown in Assignee's co-pending patent application Ser. No. 09/639,004 the disclosure of which is incorporated herein by reference.

The description of the invention is merely exemplary in nature and, thus variations that do not depart from the gist of the invention are intended to be within the scope of the invention. Such variations are not to be regarded as a departure from the spirit and scope of the invention.

What is claimed is:

1. A scroll machine comprising:

a first scroll member having a first scroll wrap extending from a first end plate, said first scroll wrap defining a first outer end;

a second scroll member having a second scroll wrap extending from a second end plate, said second scroll wrap defining a second outer end, said second scroll wrap being intermeshed with said first scroll wrap;

a drive mechanism for causing said second scroll member to orbit with respect to said first scroll member, said first and second scroll members forming a first enclosed space when said first outer end contacts said second scroll wrap and forming a second enclosed space when said second outer end contacts said first scroll wrap, said first and second enclosed spaces moving from a radial outer position to a central position during said orbiting of said second scroll member;

a single fluid injection passage extending through one of said first and second scrolls, said single fluid injection passage terminating in a single fluid port in simultaneous communication with said first and second enclosed spaces, said single fluid injection passage injecting fluid through said single fluid port into said first enclosed space and into said second enclosed space simultaneously during said orbiting of said orbiting scroll member.

2. The scroll machine according to claim 1 wherein said single fluid injection passage extends through said first scroll member.

3. The scroll compressor according to claim 1 wherein said single fluid injection passage begins communication with said first enclosed space simultaneously with the forming of said first enclosed space.

4. The scroll compressor according to claim 3 wherein said single fluid injection passage is in communication with said second enclosed space when said single fluid injection passage begins communication with said first enclosed space.

5. The scroll compressor according to claim 3 wherein said single fluid injection passage begins communication with said second enclosed space simultaneously with the forming of said second enclosed space.

6. The scroll compressor according to claim 5 wherein said single fluid injection passage is in communication with said first enclosed space when said single fluid injection passage begins communication with said second enclosed space and said single fluid injection passage is in communication with said second enclosed space when said single fluid injection passage begins communication with said first enclosed space.

7. The scroll compressor according to claim 1 wherein said first and second scroll wraps extend a different angular amount.

8. The scroll compressor according to claim 1 wherein said first scroll wrap extends a first angular amount and said second scroll wrap extends a second angular amount, said first angular amount being greater than said second angular amount.

9. The scroll compressor according to claim 8 wherein said single fluid injection passage begins communication with said first enclosed space simultaneously with the forming of said first enclosed space.

10. The scroll compressor according to claim 9 wherein said single fluid injection passage is in communication with said second enclosed space when said single fluid injection passage begins communication with said first enclosed space.

11. The scroll compressor according to claim 9 wherein said single fluid injection passages begins communication with said second enclosed space simultaneously with the forming of said second enclosed space.

12. The scroll compressor according to claim 11 wherein said single fluid injection passage is in communication with said first enclosed space when said single fluid injection passage begins communication with said second enclosed space and said single fluid injection passage is in communication with said second enclosed space when said single fluid injection passage begins communication with said first enclosed space.

13. The scroll compressor according to claim 1 wherein said single fluid injection passage extends through said second scroll member.

* * * * *

UNITED STATES PATENT AND TRADEMARK OFFICE

CERTIFICATE OF CORRECTION

PATENT NO. : 6,773,242 B1
DATED : August 10, 2004
INVENTOR(S) : Michael M. Perevozchikov It is certified that error appears in the above-identified patent and that said Letters Patent is hereby corrected as shown below:

Column 4,
Line 12, “sealing” should be -- sealingly --.
Line 19, “Member” should be -- member --.
Line 27, “Coupling” should be -- coupling --.
Line 28, “key” should be -- keys --.
Line 51, “88” should be -- 58 --.
Line 57, “horizontal” should be -- horizontally --.

Column 5,
Line 10, “1 7Q0” should be -- 170º --.
Lines 43-44, “enclosed’s pace” should be -- enclosed space --.

Signed and Sealed this

Twenty-first Day of December, 2004

JON W. DUDAS
*Director of the United States Patent and Trademark Office*